United States Patent [19]

Schoenholz et al.

[11] 3,956,197

[45] May 11, 1976

[54] CLEANING COMPOSITION IN DRY POWDER FORM

[75] Inventors: Daniel Schoenholz, Basking Ridge; Arthur Petersen, Florham Park, both of N.J.; Herbert Terry, Wilton, Conn.

[73] Assignee: Foster D. Snell, Inc., Florham Park, N.J.

[22] Filed: Apr. 15, 1971

[21] Appl. No.: 134,462

[52] U.S. Cl. ..... 252/526; 252/139; 252/312; 252/153

[51] Int. Cl.[2] ..... C11D 3/066

[58] Field of Search ..... 252/526, 114, 118, 112, 252/139, 153, 158, 162, 364, 259.5

[56] References Cited

UNITED STATES PATENTS

| | | | |
|---|---|---|---|
| 860,768 | 7/1907 | Stiefel et al. | 252/158 |
| 2,035,940 | 3/1936 | Berresford | 252/158 |
| 2,104,385 | 1/1938 | Hendrey | 252/139 |
| 2,390,406 | 12/1945 | Wegst | 252/88 |
| 2,508,035 | 5/1950 | Kosmin | 260/615 |
| 3,366,571 | 1/1968 | Cooper et al. | 252/99 |

FOREIGN PATENTS OR APPLICATIONS

| | | | |
|---|---|---|---|
| 698,560 | 11/1964 | Canada | 134/3 |

*Primary Examiner*—John D. Welsh
*Attorney, Agent, or Firm*—Mason, Kolehmainen, Rathburn & Wyss

[57] ABSTRACT

A cleaning composition in dry powder form comprising a water-soluble alkaline detergent, a water-immiscible organic liquid absorbed on said water-soluble alkaline detergent, and an emulsifying agent of such properties and in such amount that when the cleaning composition is dispersed in water, the emulsion which is formed is in an unstable condition and breaks within one hour, releasing droplets of the organic liquid, wherein the quantity of the water-soluble alkaline detergent is sufficient to absorb the organic liquid and form a free-flowing dry powder.

17 Claims, No Drawings

CLEANING COMPOSITION IN DRY POWDER FORM

This invention relates to a cleaner composition containing water-soluble and oil-soluble components in dry powder form. More particularly, this invention relates to a polyphase powder cleaner composition comprising alkaline cleaning components such as soda ash, borax, sodium phosphates and sodium silicates combined with a weak emulsifying agent and a water-immiscible organic liquid component. Such cleaning compositions are particularly adapted to cleaning pots and pans and other kitchen utensils having baked-on fats and greases.

Alkaline cleaning agents or detergents such as soda ash, borax and alkali metal phosphates and silicates are well-known cleansing compositions for metal utensils. They are, however, ordinarily ineffective in removing baked-on fats and greases which form a hard tenacious coating which resists water-soluble cleansing agents, and usually can be removed only by abrasive materials such as steel wool, pumice and other similar materials.

The present invention is based on the discovery that combinations of alkaline cleaning agents with water-insoluble organic liquids (solvents) and weak emulsifying agents form cleansing compositions which are absorbed by fats, greases and baked-on scale derived therefrom, and soften these materials so that they can be suspended in aqueous solutions containing alkaline detergents and thus removed from the metal surface on which they are adhered.

Broadly, our invention comprises granular materials, substantially soluble in water, containing absorbed water-insoluble liquid. In this type of cleaner the soluble portion of the material comprises substances which both contribute to detergency and which also provide, when the product is mixed with water prior to or during use, an unstable dispersion of water-immiscible organic liquid such that the organic liquid separates out on the articles to be cleaned, preferentially wetting the soil and thereby providing a major contribution to cleaning as a result of the solvent action of the organic liquid on the soil. There is a clear distinction between a fairly well dispersed, but weakly stabilized, oil-in-water emulsion and a simple mixture of a water-insoluble organic liquid with a granular absorbent wherein the liquid separates into a distinct layer when the composition is mixed with water.

The granular material of our composition is preferably an inorganic salt, including alkaline salts, and may include insoluble abrasive material to assist cleaning, along with such special purpose agents as emulsifiers, penetrants, oxidizers, parting agents, odorants, sanitizers, thickeners, or the like, which have been found to enhance effectiveness or convenience in use.

The active water-immiscible organic liquid solvent must be conveniently brought into the desired degree of unstable dispersion through brief agitation aided by the action of one or more emulsifiers. The latter must be so chosen as to be compatible with the other components of the mixture, whether alkaline, neutral or acidic, and to function throughout the expected range of working temperatures. As a preliminary guide for formulation, the mixed granular cleaner composition when stirred into hot water should form a turbid or milky dispersion from which at least a few drops of imperfectly emulsified organic solvent separate during the first 15 minutes (or so) of standing. This indicates that there is an excess of organic solvent over the concentration that the emulsifier can fully disperse and that some of this excess organic solvent is probably in the form of a desired metastable emulsion. If it is intended to add other components which may tend either to promote or to break emulsification of the selected organic liquid, due allowance must be made for such additional effects in selecting the type and amount of emulsifiers.

The granular compositions of this invention are readily dispersible in water. The alkaline cleaning agent dissolves in water, and the water-immiscible organic liquid or solvent is dispersed in water as a weak oil-in-water emulsion. The amount and type of emulsifying agent is selected so as to bring about the initial dispersion of the organic solvent in water. The resulting emulsion, however, should be weak and relatively unstable, and should break in a reasonably short time, so that the organic solvent, for example, in a pot and pan cleaner, forms a separate phase which "plates" out on the soil and then can soften the baked-on fats and greases and aid in their removal. Usually when the emulsions break they form milky dispersions of the organic solvent droplets in the aqueous liquid, rather than two distinct phases. The milky dispersions provide good contact between the organic solvent and the fat or grease. In cleaners for kitchen utensils, it is desirable that the emulsions should break in about 5 to 15 minutes. For other purposes, emulsions breaking in five minutes to one hour are useful.

The emulsifying agent for a particular system is selected with a hydrophile-lipophile balance number (HLB) which is slightly higher (i.e., one to two numbers) than that of the organic liquid to be emulsified. For instance, dialkyl aryl phosphates have HLB numbers of approximately 8. Thus emulsifiers having HLB numbers from 10 to 12 form metastable emulsions which break in five to ten minutes after the cleaning composition is dissolved in water. The HLB numbers for the other organic solvents disclosed herein are readily determined by known methods and suitable emulsifiers with slightly higher HLB numbers can be selected from known materials or mixtures thereof.

Alternatively, the compositions can be formulated to produce weak or unstable aqueous emulsions by including therein a quantity of emulsifying agent insufficient to form a stable emulsion in water. The quantity of a given emulsifying agent to provide a stable emulsion can be determined experimentally without difficulty by known techniques for any composition of the type described herein. Thereafter the amount of emulsifying agent is reduced to about 50 to 75% of the quantity which has been found to provide a stable aqueous emulsion and a suitable cleaning composition is obtained.

The (net) HLB number of the emulsifier in relation to that of the organic liquid must be adapted to producing and maintaining the desired degree of metastable dispersion. Some examples tested in the laboratory are given below.

| Nonionic Surfactant $R-(OCH_2CH_2)_n-OH$ | | Cloud Point, 1% solution in water | Calc'd HLB of surfactant |
|---|---|---|---|
| R | n | | |
| $C_{11}-C_{15}$ alkyl | 7 | 99°F. | 12.8 |
| $C_{11}-C_{15}$ alkyl | 9 | 140°F. | 13.8 |
| $C_{11}-C_{15}$ alkyl | 12 | 194°F. | 15.0 |
| Nonylphenyl | 9 | 64°F. | 12.1 |

The cloud point of the first surfactant in the foregoing table is undesirably lower than the expected hot water working temperatures of about 140°F. The second surfactant appeared to function better in cleaning than the others. Dioctyl phenyl phosphate was found experimentally to have an HLB value of 8.2 when fully and stably emulsified.

We have found that organic esters such as dialkyl aryl phosphates of the formula Ar—O—PO(O-alkyl)$_2$ wherein Ar represents an aromatic hydrocarbon radical, and the alkyl radicals contain 8 to 16 carbon atoms, such as dioctyl phenyl phosphate, dinonyl phenyl phosphate, dilauryl xylyl phosphate, are particularly desirable as the water-immiscible organic solvents in our compositions.

The emulsifying agent for dispersing the water-immiscible phosphoric acid ester in the aqueous solution is preferably a weak emulsifying agent such as a non-ionic dispersing agent such as a polyoxyethylene ether. The non-ionic emulsifying agent is preferably an alkyl polyoxyethylene ether of the formula Alkyl—$(OCH_2CH_2)_n$—OH wherein the alkyl radical contains 10 to 20 carbon atoms and $n$ is an integer from 3 to 20. Preferred are the compounds wherein the alkyl radical is a secondary linear radical containing 11 to 15 carbon atoms.

Dialkyl aryl phosphates are described in Gamrath and Hatton U.S. Pat. Nos. 2,678,329 (May 11, 1954) and 2,739,978 (Mar. 27, 1956) and are produced by reaction of phosphorus oxychloride with an alkanol containing 8 to 16 carbon atoms at low temperature to form a dialkyl phosphoryl monochloride which is then reacted with an alkali metal salt of a phenol to produce the dialkyl aryl phosphate. Alternative procedures are described by Coates in U.S. Pat. No. 2,732,394 (Jan. 24, 1956).

Suitable alkyl polyoxyethylene ethers are described in Barker U.S. Pat. No. 2,934,568 (Apr. 26, 1960), and particularly those having 11 to 15 carbon atoms in the alkyl radical and 10 to 20 oxyethylene groups per molecule. Others are disclosed in Snell et al. U.S. Pat. No. 2,672,449 (Mar. 16, 1954) and the patents cited therein.

A fourth component which is desirable in compositions containing a dialkyl aryl phosphate as the organic solvent is a cationic wetting agent, such as a 1-$\beta$-hydroxyethyl-1-benzyl-2-alkylimidazolinium salt of the general formula

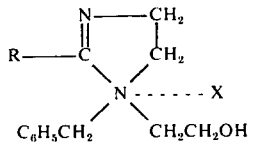

wherein R is an aliphatic hydrocarbon radical containing 6 to 21 carbon atoms and X is an anion such as Cl or Br. This component aids in the wetting out of the organic liquid or solvent on baked-on fats and grease and other soil and thus assists in the removal of such materials by enhancing concentration of the solvent on the soil layer.

These imidazolinium salts are commercially available under the trademark Monaquat from Mona Industries, Inc., Paterson, New Jersey. They are produced by reaction of 1-hydroxyalkyl-2-alkylimidazolines (described in Mayhew et al U.S. Pat. No. 2,971,006) with benzyl chloride or bromide. They can be produced in high (90–100%) purity and are soluble in water, the pH of 10% solutions or dispersions being substantially neutral. They are soluble in ethanol, isopropanol, carbon tetrachloride and toluene but insoluble in mineral spirits, kerosene and mineral oil.

When cleaning compositions of the type described above are used in cleaning metal products, they are suspended or dispersed in water and applied to the metal surfaces. The inorganic materials dissolve in the water to form an aqueous cleansing solution whereas the organic phase of phosphate ester and non-ionic emulsifying agent remains suspended in the water. In this way two phases are formed, an alkaline aqueous phase containing the alkaline inorganic salts, and a dispersed solvent phase containing the phosphate ester. The solvent phase forms a weak emulsion in water and preferentially wets the oily surfaces of the metal, including the baked-on fats and greases.

A unique characteristic of the materials of this invention is that although they contain liquids which are not soluble in water, these materials are absorbed on dry salts which are water-soluble and thus form a dry powder which is free-flowing and easily handled. The general properties of the cleaning compositions and the materials which comprise them are set forth below in more detail.

CLEANING FUNCTIONS

A. When used as a dispersion in water:
1. Pot and pan cleaner (soaking type).
2. Wiping or soaking cleaner for: oven burner drip pans, oven racks, oven doors, and oven walls (preferably in paste form for direct application); kitchen exhaust fans, outdoor grills, french friers, rotisseries and other portable cooking devices.
3. Household floor wax stripper (possibly with additions of ammonia, sodium metasilicate, alkanolamines, etc.).
4. General floor and wall cleaner.
5. General purpose dairy cleaner and sanitizer. The cationic surfactant can be partly replaced with an effective amount of germicidal quaternary ammonium compound or other suitable disinfectant, such as Hyamine 1622, a germicidal compound.
6. A car wash and white wall tire cleaner, preferably with mineral oil or some other non-paint-softening solvent in place of dioctyl phenyl phosphate.
7. Garage and gas station floor cleaner (to be flushed down the drain with a hose after use).
8. Paint brush cleaner and restorer.
9. Sheet metal degreaser and cleaner, such as in preparation for painting. A phosphating agent can be incorporated.

B. For direct use in solid form (with addition of small amounts of water as required).
1. Mechanics' hand soap, at least as effective a hand cleaner as commercial powders. Its action could be improved by addition of powdered pumice or other scouring agent.

Phenyl dioctyl phosphate is preferred because it is:

a. a highly effective softener for varnish-like, baked-on fatty residues and undecomposed fat, grease or tallow.
b. non-toxic.
c. non-irritating to skin, eyes or mucous membranes.
d. has mild, agreeable odor.

Other Organic Solvents

Other solvents, especially for use in household products, should have similar characteristics. These include a. tributyl phosphate — nearly water insoluble, but easily emulsified and has considerable solvent action against baked fats.
b. tripropyl, triisobutyl, tripentyl and trihexyl phosphates as well as mixed mono-, di- or tri- alkyl esters of phosphoric acid.
c. higher aliphatic phosphates (such as dioctyl, trioctyl, and tridecyl) have much less solvent action directly on baked hard coatings, and would have to be compounded and emulsified as with dioctyl phenyl phosphate.
d. higher aryl and alkaryl phosphates are effective. Triphenyl and tricresyl phosphates are undesirably toxic, but have cleaning activity similar to dioctyl phenyl phosphate when suitably emulsified. Other effective cleaning agents include the di- and trialkylphenyl phosphates and their homologs, analogs and isomers.
e. The commercial mixtures of terpene alcohols and other oxygenated terpenes known as pine oil provide an effective solvent, but one with a little less cleaning action than dioctyl phenyl phosphate. Various commercially available grades have about the same cleaning effectiveness.
f. Terpenoid solvents consisting largely of terpene hydrocarbons such as alpha- and beta-pinene, dipentene, and various commercial fractions high in this class of component have been found to be less effective than the terpenoid alcohols but are operative.
g. Liquid N-substituted aryl sulfonamides, substantially water immiscible, such as N-ethyl-o- and p-toluenesulfonamides ("Santicizer 8"), have solvent action directly on baked lard and in emulsified form. This class of compounds is disclosed in U.S. Pat. No. 3,410,805 to Goldsmith et al., particularly at column 3, and are effective in alkaline solution (e.g. as a paint stripper) containing about 80% sodium hydroxide, 5 to 10% of a sulfonamide and about 10 to 15% of a water-soluble lower glycol ether.
h. N-substituted toluamides such as N,N-diethyl-m-toluamide are liquid, non-toxic, almost odorless, and water-insoluble. The diethyl compound has considerable solvent action directly on baked lard or when emulsified in water. Other suitable analogs include N-monomethyl, N-monoethyl, N-monopropyl, N-monobutyl toluamides (ortho, meta, and para), N,N-dimethyl-, N,N-dipropyl-, N,N-dibutyl toluamides, analogous N-substituted benzamides and N-substituted ring-alkylated benzamides which are liquid and approximate the other solvent requirements.
i. Miscellaneous chlorinated solvents - orthodichlorobenzene ("Ozene"), chlorbenzene, and other liquid chlorinated aromatic hydrocarbons have considerable cleaning action when emulsified as above.
j. Higher substituted aliphatic esters such as butyl acetylricinoleate (in alkaline emulsion).

Quantity of water-insoluble organic liquid (solvent)

The minimum amount of organic liquid or solvent is usually about 2% of the weight of the total dry solids in the composition. Below that value no cleaning action beyond that of the water-soluble materials (e.g., sodium silicate and sodium carbonate) is observed. The maximum amount of organic liquid is usually about 35% of the weight of the total dry solids in the composition. Above that value the mixture is too wet to serve as a solid, free-flowing cleaner. The preferred amount of water-insoluble organic liquid is in the range from 15 to 25% of the weight of the total dry solids. The upper limits of the organic liquid vary, of course, with the absorbency of the solids in the cleaning compositions and sometimes it is possible to exceed 35% of organic liquid in certain formulations and still produce a dry product. Likewise, the lower value of the organic liquid can vary from the 2% figure given above depending upon the cleaning effectiveness of the organic liquid. With liquids of high efficiency, suitable cleaning compositions can be produced with only 1% liquid based on the weight of dry solids.

Water-miscible solvents

Various glycols and glycol esters can, if desired, be added to this alkaline emulsified solvent mixture to aid in softening partly burned carbohydrates or other soils susceptible to such softening action. The following have been found effective: monobutyl ether of ethylene glycol, monomethyl ether of propylene glycol, dipropylene glycol monomethyl ether, tripropylene glycol monomethyl ether, mixed isobutyl ethers of propylene glycol and its homologs, n-hexyl ether of diethylene glycol. Other suitable glycol ethers are listed in Goldsmith et al. U.S. Pat. No. 3,410,805. Also effective are dimethylformamide, N-methyl-2-pyrolidone, and 2-pyrolidone.

Solid carriers may be used for the liquid components to yield a solid product i.e., to function as absorbents for the liquid components such that an effective percentage of liquids will be present in the final mixture without impairing its solid granular, free-flowing form. Among such carriers are the following:

A. Porous, absorbent, water-soluble materials
Granular $Na_2CO_3$ holds about 30% dioctyl phenyl phosphate or 25% mixed liquids. Puffed borax (12–15 lbs./cu.ft) holds about 40% dioctyl phenyl phosphate.
B. Highly porous water-insoluble inorganic carriers
Colloidal silica (Cab-O-Sil) - holds (about) 250% dioctyl phenyl phosphate.
Synthetic calcium silicate (Microcel E) — (about) 150% dioctyl phenyl phosphate.
diatomaceous earth — (about) 85% dioctyl phenyl phosphate.
Bentonite — (about) 60% (liquid mix).
C. Absorbent water-insoluble organic carriers
Wood flour holds about 50% dioctyl phenyl phosphate and other commercially available plant materials such as ground bark, bagasse and cellulosic waste are useful.
D. Less porous water-soluble inorganic carriers
Light soda ash holds about 25% dioctyl phenyl phosphate.

Dense soda ash holds about 10% dioctyl phenyl phosphate.

G. D. sodium silicate holds about 5% dioctyl phenyl phosphate.

Other non-porous carriers include:
sodium tripolyphosphate,
tetrasodium pyrophosphate,
commercial detergent phosphates,
grades of (dry) sodium silicate,
sodium sulfate,
borax
sodium sesquicarbonate,
sodium bicarbonate.

E. Less porous water-insoluble inorganic carriers
Kaolin holds about 40% of liquid mix.
Pumice holds about 25% of liquid mix.
Tripoli holds about 24% of liquid mix.
Talc holds about 24% of liquid mix.
Others in this class are ground chalk, feldspar, silex, fullers earth, and similar polishing, scouring or filling materials.

Water-soluble salts serve:

1. As builders or promoters of cleaning action, or cleaners in their own right.
2. As carriers for the liquid components.
3. As a means of adjusting the alkalinity or acidity of the working solutions so as to aid the cleaning action.
4. As low cost, dispersible fillers (if desired).

Preferred examples include $Na_2CO_3$, sodium silicates (preferably rapidly soluble grades in the range of $Na_2O$ to $SiO_2$ ratio of 1 to 2). Other suitable salts are sodium tripolyphosphate, tetrasodium pyrophosphate, trisodium phosphate, and sodium meta phosphates which are well known as detergent builders and will function efficiently in the present products.

Alkaline compounds of relatively low pH, and especially if of high buffering action, tend to reduce the cleaning action of more alkaline detergent salts, examples being borax (sodium tetraborate), sodium bicarbonate, and sodium sesquicarbonate. Nearly neutral salts such as sodium chloride and sodium sulfate may be desirable as simple fillers without activity.

The ammonium, potassium or lithium salts of the foregoing perform very much like the sodium salts and can be substituted therefor.

Alkalizing compounds, such as small amounts of water-soluble alkylamines or alkanolamines (such as mono-, di-, or triethanolamine) may be absorbed on one of the foregoing cariers, or ammonium hydroxide may be generated in the working dispersion by adding a solid ammonium salt such as ammonium chloride or sulfate, or an ammonium neutralized surfactant, plus a strongly alkaline solid material such as quicklime, dry slaked lime, sodium metasilicate, or trisodium phosphate.

Acidic compounds are compatible with dioctyl phenyl phosphate and non-ionic emulsifiers. They can be used for acidic operations such as metal cleaning, pickling, or metal preparation, and toilet bowl and plumbing cleaning and disinfecting. Examples include $NaHSO_4$, $NaHSO_3$, sulfamic acid, gluconic acid, citric and tartaric acids, and liquid mineral acids absorbed on suitable carriers.

Emulsifiers and auxiliary surfactants

For alkaline cleaning of metals, cationic surface-active agents improve wetting of the soil by the solvents. This in turn requires use of a non-ionic primary emulsifier for compatibility.

Other than for such secondary considerations, any anionic, non-ionic or amphoteric emulsifying agent can be used; for instance, those enumerated in U.S. Pat. No. 3,459,670 to Carter and particularly columns 3 and 4, provided that the requirement for a metastable dispersion is met.

In addition, conventional soap-like materials can also be used provided that they can be adjusted to give the desired metastable dispersion with the selected solvent or solvents. These include sodium, potassium, ammonium and mono-, di-, or triethanolamine oleates, as well as similar soaps and salts of other fatty acid mixtures in the usual soap-like range of carbon chain lengths (i.e., 10 to 20 carbons).

Hydrotropes or auxiliary emulsion coupling and soaking agents can be included. These comprise certain low molecular weight, anionic hydrotropic materials which promote and balance emulsification or aid the soaking and cleaning action, particularly of mixtures containing water-soluble auxiliary solvents such as the glycol esters. Examples of such materials are sodium toluenesulfonate, sodium xylenesulfonate, and similar compounds. However, these materials, being anionic, will be incompatible with any cationic surfactants present in the formulation.

Other surfactants which are useful in this invention include the following:

Anionic

Sodium xylenesulfonate
Sodium linear alkylbenzenesulfonates
Mixed fatty acid diethanolamines (1:2 fatty acid to diethanolamine ratio)
Isopropylamine linear alkylbenzenesulfonates
Dimethylamine linear alkylbenzenesulfonates
Triethanolamine oleate
Monoethanolamine oleate
Sodium 2-ethylhexyl sulfate

Cationic

Diisobutylphenooxyethoxyethyl-dimethyl-benzylammonium chloride
Alkyl-dimethyl-benzylammonium chloride (where alkyl is, for example, 50% $C_{14}$, 40% $C_{12}$ and 10% $C_{16}$)
Alkyltrimethylammonium chloride (where alkyl is derived from tallow acids, largely $C_{16}$ and $C_{18}$)
Lauryltrimethylammonium chloride
Polyethoxyalkylamines
Ethylene oxide condensation products of the primary amines derived from coconut oil fatty acids, soybean fatty acids, or the like
Dimethylamine oxide derived from coconut oil fatty acids, hydrogenated tallow fatty acids, and similar materials
Dimethylhexadecylamine oxide
Quaternary benzyl ammonium chloride derivatives of 1-ethylhydroxy-2-alkyl-imidazoline (the alkyl from tallow oil fatty acids, coconut oil fatty acids, or the like)
Oleic substituted imidazoline ethyl sulfate
Quaternary ethoxy substituted imidazoline derived from tall oil Non-ionic Ethoxylated nonylphenol with typically 4 to 11 ethoxy units in the chain
Ethoxylated dodecyl phenol with typically 6 or 9 ethoxy units in the chain
Mixed $C_{11}$ to $C_{15}$ isomeric linear secondary alcohols ethoxylated with 5 to 12 ethoxy units in the chain
Octyl-phenoxy-polyethoxy-ethanols of varying ethoxy chain lengths
Lauryl isopropanolamide
Oleic acid diethanolamide
Mixed fatty acid diethanolamides
Ethoxylated straight chain $C_{10}$ to $C_{18}$ "oxo process" alcohols containing 40% to 60% ethylene oxide chains
Polyethylene glycol monoleates, or dioleates
Coconut fatty acid monoethanolamide (1:1 amine/acid ratio)
Coconut fatty acid diethanolamine (1:1 amine/acid ratio)
Polyoxyethylene polyol fatty acid esters
Polyoxyethylene (4 chain units) lauryl ether Amphoteric Amphoteric imidazolinium surfactants of the formulas

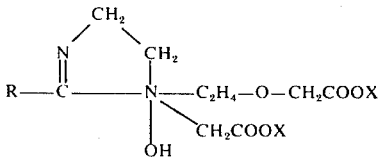

and

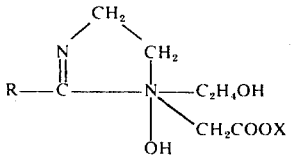

wherein X is a cation such as sodium, potassium, ammonium or an amine such as isopropanolamine, ethanolamine, diethanolamine or triethanolamine and R is an aliphatic hydrocarbon radical containing eleven to seventeen carbon atoms, are operative. These surfactants are sold commercially as Miranol C2M-SF, Miranol C2M-IPA, Miranol M2M-MEA and Miranol CM Miranol Chemical Co.

The invention is further disclosed by means of the following examples which are provided for purposes of illustration only.

EXAMPLE 1

A solution is prepared by dissolving with good agitation 14.30 lbs. of a polyoxyethylene ether of the following formula $$RR'CH-(OCH_2CH_2)_n-OH$$

wherein R and R′ are alkyl radicals and the average number of carbon atoms in the two alkyl groups is 12 and the average value of n is 9, and 12.85 lbs. of a quaternary salt of the formula

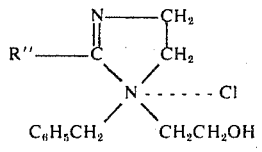

wherein R″ is an alkyl radical containing an average of between 15 and 16 carbon atoms, in 72.85 lbs. of dioctyl phenyl phosphate. 21 lbs. of this solution is added with good agitation in a powder blender to 16 lbs. of borax (15-lb. density grade) and mixing continued until a uniform product is obtained. Then 51 lbs. of light soda ash and 12 lbs. sodium metasilicate are added and mixing continued until a uniform powder is produced.

The resulting product is a dry, free-flowing powder having a density of 38.7 lbs. per cubic foot. As a pot and pan cleaner it is preferably used at a concentration of 4 ounces per gallon of warm water.

The efficiency of the foregoing cleaning composition was demonstrated by its effect on aluminum strips having bacon grease baked thereon for one-half hour at 475°F. These strips were cleaned by soaking in hard water containing varying amounts of the cleaning composition. The following table sets forth the effect of the cleaning composition at varying temperatures and concentrations on the baked metal strips, without agitation.

| Temp. (°F.) | Concentration (oz. per gal.) | Appearance after 15 minutes | Appearance after 30 minutes |
|---|---|---|---|
| 120 | 2 | no effect | no effect |
| | 4 | no effect | 20% removal |
| | 6 | 20% removal | 100% removal |
| 140 | 2 | 100% removal | 100% removal |
| | 4 | 100% removal | 100% removal |
| | 6 | 100% removal | 100% removal |
| 160 | 2 | 100% removal | 100% removal |
| | 4 | 100% removal | 100% removal |
| | 6 | 100% removal | 100% removal |

EXAMPLE 2

| | |
|---|---|
| Light granular sodium carbonate (porous) | 67.0 lbs. |
| Sodium silicate ($SiO_2:Na_2O$=2.0:1.0) | 12.0 lbs. |
| Dioctyl phenyl phosphate | 9.0 lbs. |
| Linear secondary alcohol with average of 12 carbon atoms, a biodegradable nonionic emulsifier (Tergitol 15-S-9) | 9.0 lbs. |
| Imidazolinium salt (as in Example 1), Monoquat TIBC | 3.0 lbs. |
| | 100.0 lbs. |

The last three materials were thoroughly mixed and then added to the porous sodium carbonate in a powder mixer, followed by the sodium silicate. The product was a free-flowing powder. In use about 4 ounces of the above granular product is mixed with about 1 gallon of hot water at about 140°F. to form an aqueous cleaning dispersion.

In this example: (a) The sodium carbonate serves both as an alkaline detergent salt and, being porous, as a solid carrier for the liquid components; (b) The sodium silicate serves to inhibit corrosion of aluminum objects while being cleaned with the product, and buffers the pH at a high value, promoting cleaning action; (c) The dioctyl phenyl phosphate acts as a water-immiscible active solvent and cleaner which is capable of being emulsified in water to form an unstable dispersion; (d) The linear secondary alcohol is a primary nonionic emulsifying agent selected for its ability to aid in forming the above described unstable dispersion of the organic phosphate ester in water, being also desirably biodegradable; and (e) The imidazolinium salt is a cationic surfactant which aids in bringing the aqueous solvent dispersion to the desired degree of gradual instability and which also specifically promotes wetting and penetration of baked fatty soils by the water-immiscible solvent.

We claim:

1. A composition in dry powder form at ambient temperature and pressure useful for cleaning when mixed with water comprising:

a. a water-soluble alkaline detergent, b. a water-immiscible organic liquid absorbed on said water-soluble alkaline detergent in an amount of at least 1% by weight of the total dry solids in said composition, and c. an emulsifying agent which has an HLB number higher than that required for the water-immiscible organic liquid wherein the cleaning composition, when dispersed in water, forms an unstable emulsion which breaks within 1 hour, releasing droplets of the organic liquid, wherein the quantity of the water-soluble alkaline detergent is sufficient to absorb the organic liquid and form a free-flowing dry powder.

2. A cleaning composition as defined by claim 1 wherein the water-soluble alkaline detergent is an organic salt.

3. A cleaning composition as defined by claim 2 wherein the water-immiscible organic liquid is a dialkyl aryl phosphate.

4. A cleaning composition as defined by claim 2 wherein the emulsifying agent has an HLB number one to two digits higher than that of the water-immiscible organic liquid.

5. A cleaning composition as defined by claim 2 wherein the water-immiscible liquid is an organic phosphoric acid ester.

6. A cleaning composition as defined by claim 2 wherein the water-immiscible liquid is a terpene alcohol or hydrocarbon.

7. A cleaning composition as defined by claim 2 wherein the water-immiscible liquid is a liquid aryl sulfonamide.

8. A cleaning composition as defined by claim 2 wherein the water-immiscible liquid is a liquid halogenated aromatic hydrocarbon.

9. A cleaning composition as defined by claim 2 wherein the water-immiscible liquid is a liquid N-alkylated toluamide.

10. A cleaning composition as defined by claim 3 wherein the dialkyl aryl phosphate is dioctyl phenyl phosphate.

11. A cleaning composition as defined by claim 4 wherein the emulsifying agent is an alkyl polyoxyethylene ether.

12. A composition in dry powder form at ambient temperature and pressure useful for cleaning when mixed with water comprising:

a. a water-soluble alkaline detergent, b. a water-immiscible organic liquid absorbed on said water-soluble alkaline detergent in an amount of at least about 1% by weight of the total dry solids in said composition, and c. an emulsifying agent in an amount which is insufficient to form a stable emulsion when the cleaning composition is dispersed in water, releasing droplets of the organic liquid, wherein the quantity of the water-soluble alkaline detergent is sufficient to absorb the organic liquid and form a free-flowing dry powder.

13. A cleaning composition as defined in claim 12, wherein the amount of emulsifying agent is 50–75 percent of that quantity necessary to provide a stable emulsion of the cleaning composition in water.

14. A cleaning composition as defined in claim 3 which further includes a cationic wetting agent.

15. A cleaning composition as defined in claim 12 wherein the cationic wetting agent is a 1-3-hydroxyethyl-1-benzyl-2 alkylimidazolinium salt of the formula

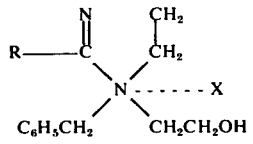

wherein R is an aliphatic hydrocarbon radical containing 6 to 21 carbon atoms and X is an anion.

16. A composition as defined in claim 15 wherein X is bromine.

17. A composition as defined in claim 15 wherein X is chlorine.

* * * * *

UNITED STATES PATENT OFFICE

CERTIFICATE OF CORRECTION

Patent No. 3,956,197 Dated May 11, 1976

Inventor(s) Daniel Schoenholz, Arthur Petersen and Herbert Terry

It is certified that error appears in the above-identified patent and that said Letters Patent are hereby corrected as shown below:

Column 11, line 32, "organic" should read -- inorganic --.

Signed and Sealed this

Twentieth Day of July 1976

[SEAL]

*Attest:*

RUTH C. MASON
*Attesting Officer*

C. MARSHALL DANN
*Commissioner of Patents and Trademarks*